US012270161B2

(12) United States Patent
Thiesse et al.

(10) Patent No.: US 12,270,161 B2
(45) Date of Patent: Apr. 8, 2025

(54) AUTOMATED MECHANICAL SYSTEM TO POSITION SCREED AT STARTING PAVING DEPTH

(71) Applicant: Caterpillar Paving Products Inc., Brooklyn Park, MN (US)

(72) Inventors: Chad M. Thiesse, Brooklyn Park, MN (US); Bradley D Anderson, Rogers, MN (US); Ryan T. Thiesse, Otsego, MN (US); Ronald D. Wilson, Maple Grove, MI (US); Rick L. Mings, Oak Grove, MN (US); Bryan J. Downing, Champlin, MN (US); Anthony Paul Steinhagen, Maple Grove, MN (US); Mathew J. Hedrington, Ham Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 838 days.

(21) Appl. No.: 17/489,216

(22) Filed: Sep. 29, 2021

(65) Prior Publication Data

US 2023/0097444 A1 Mar. 30, 2023

(51) Int. Cl.
*E01C 19/48* (2006.01)

(52) U.S. Cl.
CPC ..... *E01C 19/4873* (2013.01); *E01C 2301/14* (2013.01)

(58) Field of Classification Search
CPC ..... E01C 19/4873; E01C 2301/14
USPC ..... 404/84.05–84.5, 118
See application file for complete search history.

(56) References Cited

U.S. PATENT DOCUMENTS

| | | | | |
|---|---|---|---|---|
| 6,183,160 | B1 | 2/2001 | Tapio et al. | |
| 8,128,314 | B2 | 3/2012 | Buschmann et al. | |
| 8,221,025 | B2 | 7/2012 | Buschmann et al. | |
| 9,200,415 | B2 | 12/2015 | Graham et al. | |
| 10,889,942 | B2 | 1/2021 | Frelich | |
| 2015/0063907 | A1* | 3/2015 | Graham | E01C 23/07 715/745 |
| 2018/0030672 | A1* | 2/2018 | Marsolek | E01C 23/07 |

FOREIGN PATENT DOCUMENTS

| | | | | |
|---|---|---|---|---|
| CN | 106149528 | | 11/2016 | |
| EP | 3498915 | A1 * | 6/2019 | B60G 17/005 |
| EP | 3892777 | A1 * | 10/2021 | E01C 19/268 |

* cited by examiner

*Primary Examiner* — Raymond W Addie

(57) ABSTRACT

A paving machine can include a frame; a screed coupled to the frame, the screed including one or more screed plates; one or more movable extender mechanisms located at a back end of each screed plate and configured to extend and retract up and down beneath the screed plate; and a controller configured to extend the one or more extender mechanisms a pre-determined distance before the screed begins a paving operation and to retract the one or more extender mechanisms after the screed has begun the paving operation.

20 Claims, 4 Drawing Sheets

AUTOMATED MECHANICAL SYSTEM TO POSITION SCREED AT STARTING PAVING DEPTH

TECHNICAL FIELD

The present disclosure generally relates to paving equipment. More particularly, the present disclosure relates to an asphalt paving machine.

BACKGROUND

Paving machines are used to apply, spread, and compact paving material relatively evenly over a desired surface. These machines are regularly used in the construction of roads, parking lots and other areas where a smooth durable surface is required for cars, trucks, and other vehicles to travel. An asphalt paving machine generally includes a hopper for receiving asphalt material from a truck and a conveyor system for transferring the asphalt rearwardly from the hopper for discharge onto a roadbed. Screw augers may be used to spread the asphalt transversely across the roadbed in front of a screed. A screed plate on the screed smooths and somewhat compacts the asphalt material and ideally leaves a roadbed of uniform depth and smoothness.

As part of the normal paving process, several steps are required to properly setup the screed for it to pave a consistent asphalt mat. Many of these setup steps currently require human input to complete. To help minimize the need for human input, ultimately creating a safer operating environment for machine operators, many of these setup steps could be automated.

U.S. Pat. No. 6,183,160 describes a screeding assembly and controls for positioning the screed assembly.

SUMMARY

In an example according to this disclosure, a paving machine can include a frame; a screed coupled to the frame, the screed including one or more screed plates; one or more movable extender mechanisms located at a back end of each screed plate and configured to extend and retract up and down beneath the screed plate; and a controller configured to extend the one or more extender mechanisms a pre-determined distance before the screed begins a paving operation and to retract the one or more extender mechanisms after the screed has begun the paving operation.

In one example, a paving machine can include a frame; a screed coupled to the frame by a tow arm, the screed including a primary screed plate; two movable extender mechanisms, one of each of the two movable extender mechanisms located at each rear corner of the primary screed plate, the two movable extender mechanisms configured to extend and retract up and down beneath the primary screed plate; and a controller configured to extend the one or more extender mechanisms a pre-determined distance before the screed begins a paying operation to define a starting depth and to retract the one or more extender mechanisms after the screed has begun the paving operation.

In one example, a method of setting up a screed prior to a paving operation can include extending one or more extender mechanisms downward beneath a bottom surface of a screed plate to define a starting depth for the screed plate; and retracting the one or more extender mechanisms after the paving operation has begun.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
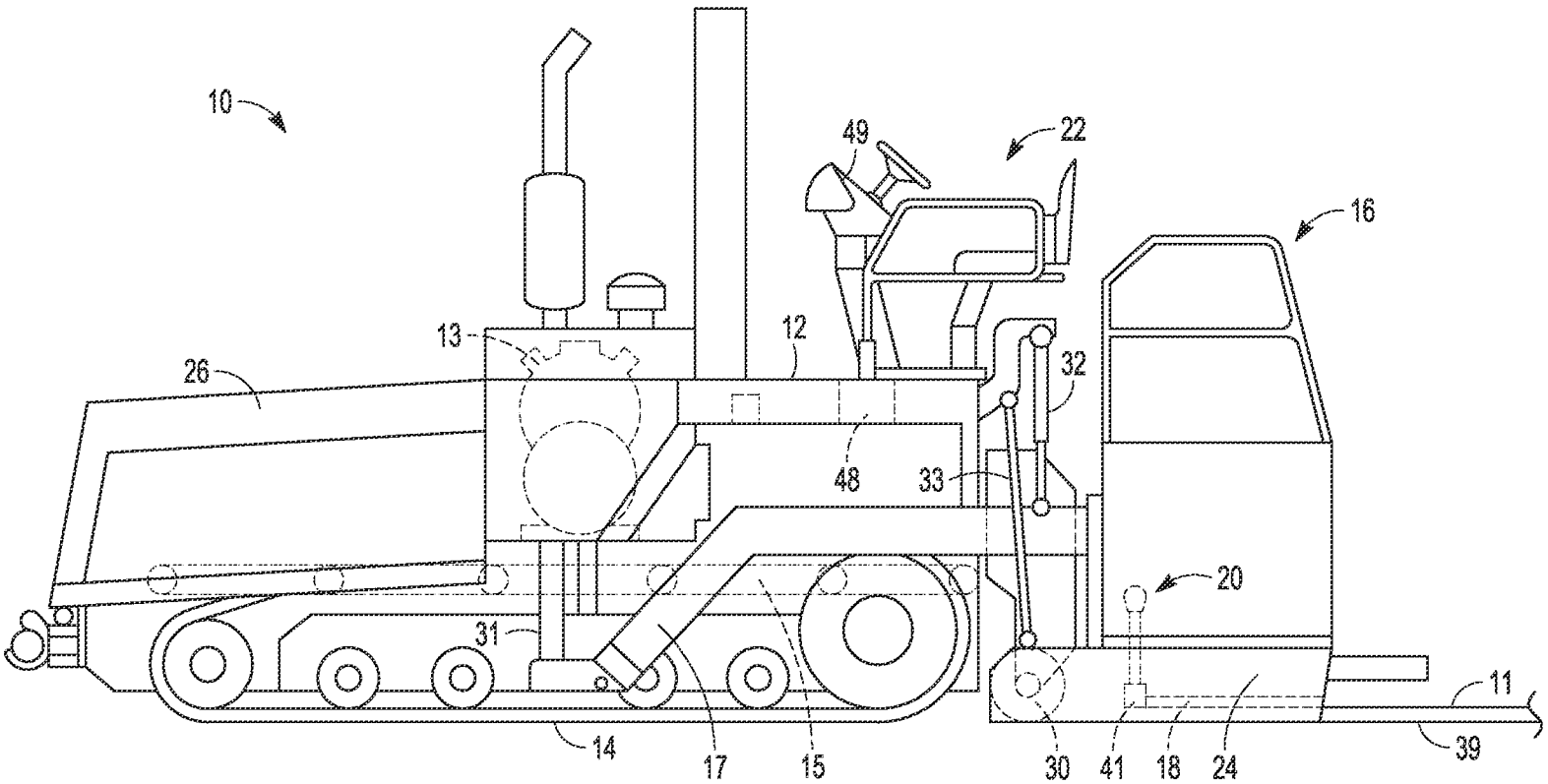
FIG. 1 shows a side view of a paving machine, in accordance with one embodiment.

FIG. 1 shows a side view of a paving machine 10 in accordance with one embodiment. The paving machine 10 generally includes a frame 12 with a set of ground-engaging elements 14 such as tracks or wheels coupled with the frame 12. The ground-engaging elements 14 may be driven by an engine 13 in a conventional manner. A screed 16 can be positioned at the rear end of the paving machine 10 to spread and compact paving material into an asphalt mat 11 having a desired thickness, size, uniformity, crown profile and cross slope. The paving machine 10 also includes an operator station 22 having a seat and a console, which includes various controls for directing operations of the paving machine 10 by inputting instructions at an input panel 49. A controller 48 is provided for electrically controlling various aspects of the paving machine 10. For example, the controller 48 can send and receive signals from various components of the paving machine during the operation of the paving machine 10.

The paving machine 10 further includes a hopper 26 for storing the paving material, and a conveyor system including one or more conveyors 15 configured to move paving material from the hopper 26 to the screed 16 at the rear of the paving machine 10. One or more augers 30 are arranged near the forward end of the screed 16 to receive the paving material supplied by the conveyor 15 and spread the material evenly beneath the screed 16.

Reference to the "forward" end of the screed 16 means the end of screed 16 facing in the direction of travel of paving machine 10 as paving machine 10 is applying the paving material to a surface (to the left in FIG. 1). Similarly, reference to a "forward-facing" surface of a component of screed 16 means a surface facing in the direction of travel of paving machine 10 while paving machine 10 is applying paving material to an existing base 39, while reference to an "aft-facing." surface of a component means a surface facing away from the direction of travel of paving machine 10 while paving machine 10 is applying paving material to a surface (to the right in FIG. 1).

The screed 16 can be pivotally coupled behind the paving machine 10 by a pair of tow arms 17 that extend between the frame 12 of the paving machine and the screed 16. The tow arms 17 can be pivotally connected to the frame 12 such that the relative position and orientation of the screed 16 relative to the screed frame and to the surface being paved may be adjusted by pivoting the tow arms 17, for example, in order to control the thickness of the paving material deposited by the paving machine 10. The tow arm 17 can also have the tow point raised and lowered on the machine 10 using a positioning cylinder 31 which when moved up and down moves the tow point of the tow arm and changes an angle of attach of the screed 16. Also, as part of the paving set-up process, one or more cylinders 32, 33 on the screed can raise or lower portions of the screed during setup.

The screed 16 can include a screed frame 24 with a screed plate 18 coupled to the screed frame 24. The screed plate 18 is configured to float on the paving material of the asphalt mat 11 laid upon a prepared existing base 39 and to "smooth" or level and compact the paving material on the base surface, such as for example a roadway or roadbed.

The screed 16 can include a tamper bar assembly 20 positioned forward of the screed plate 18 and extending transversely to the direction of travel of the paving machine 10. The tamper bar assembly 20 may include a tamper bar 41. Tamper bar assembly 20 can be coupled to the screed frame 24 of screed 16 and configured such that the tamper bar 41 is reciprocated in an upward and downward direction substantially perpendicular to the asphalt mat 11 and substantially perpendicular to the direction of travel of paving machine 10.

As noted above, as part of the normal paving process, several steps are required to properly setup the screed 16 for it to pave a consistent/uniform asphalt mat 11. Many of these setup steps currently require human input to complete. To help minimize the need for human input many of these setup steps could be automated.

For example, the setup process can include raising or lowering the tow point of the tow arms 17 and raising and lowering portions of the screed the screed using cylinders 32, 33.

The present system focuses on automating the setup step of lowering or "floating" the screed 16 down to the starting paving depth reference point. This starting depth reference point is presently structural in nature and physically supports the weight of the screed at the proper paving depth. Presently, the most common type of starting depth reference is simple wooden starter boards. Paving crews often carry several boards on the machine to accommodate the many various paving starting depths they could encounter on any given jobsite. These starter boards usually remain with the machine taking up valuable space on the machine that could be used for other purposes. Also, these starter boards require operators to manually place the starter boards below the screed as required, depending on paving depth at the start of each paving pass. So, this process is now 100% manual.

Figure 2:
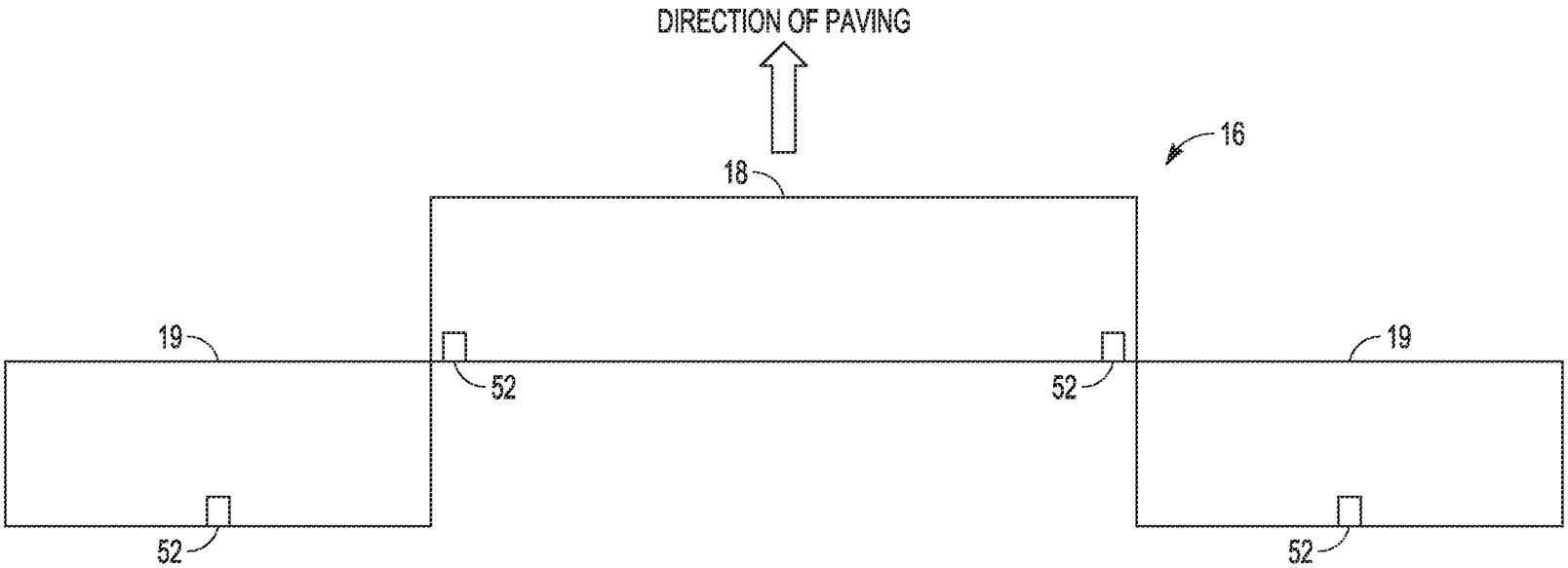
FIG. 2 shows a schematic bottom view of a screed, in accordance with one embodiment.
Figure 3:
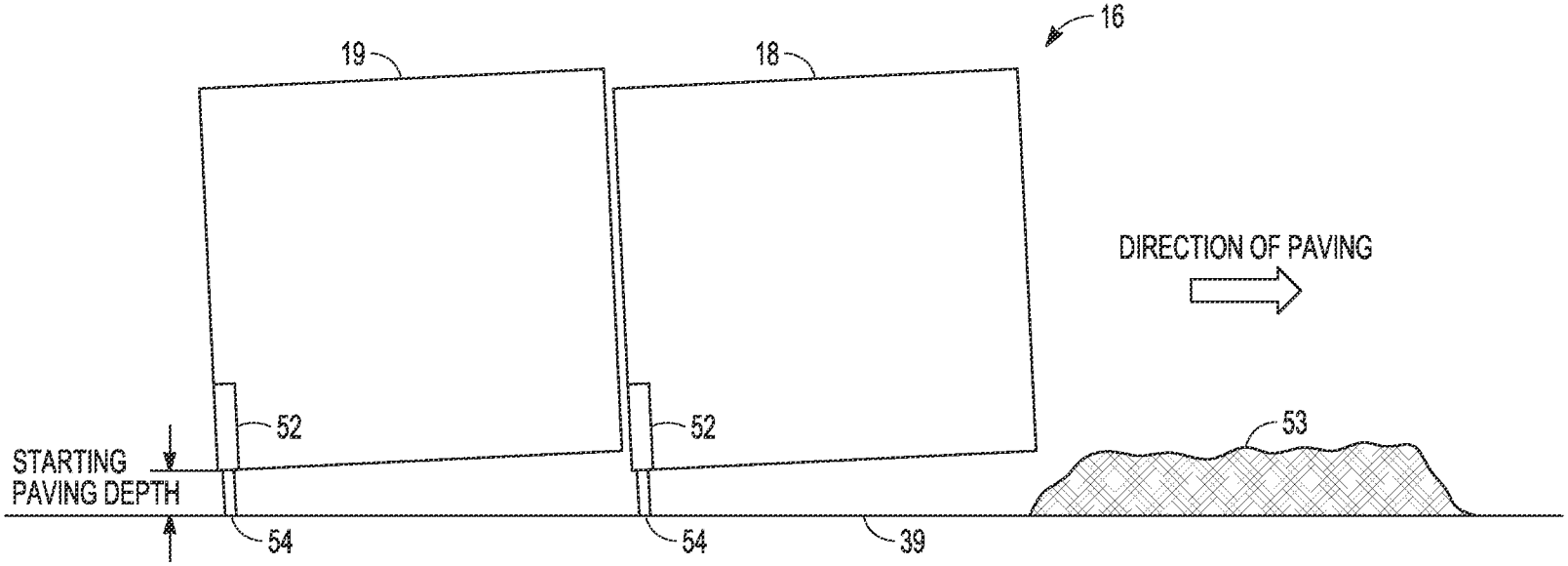
FIG. 3 shows schematic side view of the screed, in accordance with one embodiment.

FIG. 2 shows a schematic bottom view of the screed 16, in accordance with one embodiment; and FIG. 3, shows schematic side view of the screed 16. Here, are shown screed plates of the screed 16 including a primary screed plate 18 and extender screed plates 19, which extend outward on either side of the primary screed plate 18.

To provide a starting point depth reference for the screed 16, the present system provides one or more movable extender mechanisms 52 located at a back end of each screed plate 18, 19 and configured to extend and retract up and down beneath the screed plate 18, 19. In one example, two movable extender mechanisms 52 are positioned at each rear corner of the primary screed plate 18.

The controller 48 (FIG. 1) can be configured to extend the one or more extender mechanisms 52 a pre-determined distance before the screed 16 begins a paving operation to define a starting depth and then to retract the one or more extender mechanisms 52 after the screed 16 has begun the paving operation.

Accordingly, to automate the process of placing physical starting depth items, the screed 16 includes the extender mechanisms 52 on the screed plates 18, 19 so as to act as a starting depth mechanism that can be fully integrated into the screed 16. In some embodiments, the extender mechanisms 52 can include position sensing cylinders, electrical threaded actuators, or other controllable structural mechanisms. The extender mechanisms 52 can be rigidly mounted to the screed plates 18, 19 and placed along the rear edge of the screed plates 18, 19 to accommodate the next step of screed nulling during the setup process.

In various examples, there can be one or more of these extender mechanisms 52 on each left and right corner of the screed main plate 18 and each left and right screed extender plate 19. In one example, the extender screed plates 19 can each include a single extender mechanism 52 positioned at approximately a midpoint of the width of the extender screed plate 19. These automated extender mechanisms 52 can be controlled by the machine ECM controller 48 to set the proper starting depth.

For example, as part of the job setup, the operator would input a starting paving depth via the machine control input panel 49 (FIG. 1). The machine controller 48 would then use this starting paving depth to send commands (via hardwire or CAN network) to extend each of these extender mechanisms 52 (i.e., a position sensing cylinder or an electrical actuator) to the correct extended length to match the specified starting paving depth.

During setup, when the screed 16 is lowered to the existing base 39, these extender mechanisms 52 physically contact the existing base 39 and support the screed plates 18, 19 at the proper starting paving depth. Once the paving machine 10 starts to move forward beginning to pave, the screed weight will eventually be supported by an asphalt material 53 flowing under the screed 16 at which time the starting depth extender mechanisms 52 can be retracted up into the screed 16 so that the bottom surfaces of the screed plates 18, 19 define flat planar surfaces for riding over the asphalt material 53 to form the asphalt mat. Timing of the extender mechanism 52 retraction process can be either timer based or distance travelled; both of which can be controlled by the machine controller 48.

In one example, the controller 48 retracts the one or more extender mechanisms 52 after the screed plate 18, 19 has travel led approximately ⅔ of the length of the screed plate 18, 19. Thus the extender mechanisms 52 are retracted, before they meet the asphalt material 53 and the screed can finish forming the asphalt mat 11.

In one example, the one or more extender mechanisms 52 can include a wear plate 54 on a bottom surface of the extender mechanism 52. As the wear plates degrade with use, they can be replaced.

INDUSTRIAL APPLICABILITY

The present system can be applicable to paving systems. The current setup process for preparing a screed can be time consuming and requires many manual steps. To help with the setup step of lowering or "floating" the screed 16 down to a proper starting paving depth reference point, the present system provides physical extender mechanisms 52 incorporated in the screed plates 18, 19 of the screed 16.

Figure 4:
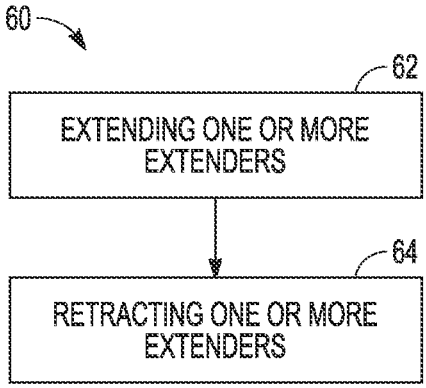
FIG. 4 shows a method setting up a screed prior to a paving operation, in accordance with one embodiment.

FIG. 4 shows a method 60 for setting up a screed prior to a paving operation, in accordance with one embodiment. The method can include extending (62) one or more extender mechanisms 52 downward beneath a bottom surface of a screed plate 18, 19 to define a starting depth for the screed plate 18, 19. The method 60 further includes retracting the one or more extender mechanisms (64) after the paving operation has begun.

The retraction of the extender mechanisms 52 can be based on a timer or on a distance traveled. For example, the controller can retract the one or more extender mechanisms 52 after the screed plate has travelled approximately ⅔ of the length of the screed plate.

The above detailed description is intended to be illustrative, and not restrictive. The scope of the disclosure should, therefore, be determined with references to the appended claims, along with the full scope of equivalents to which such claims are entitled.

What is claimed is:

1. A paving machine comprising:

a frame;

a screed coupled to the frame, the screed including one or more screed plates;

one or more movable extender mechanisms located at a back end of each screed plate and configured to physically extend and retract up and down beneath a bottom surface of the screed plate such that, when extended beneath the bottom surface of the screed plate, the movable extender mechanisms physically contact a base surface; and a controller configured to extend the one or more extender mechanisms a pre-determined distance beneath the bottom surface of the screed plate before the screed begins a paving operation and to retract the one or more extender mechanisms upwards after the screed has begun the paving operation.

2. The paving machine of claim 1, wherein the one or more movable extender mechanisms include position sensing cylinders.

3. The paving machine of claim 1, wherein the one or more movable extender mechanisms include threaded actuators.

4. The paving machine of claim 1, wherein the screed is coupled to the frame by a tow arm.

5. The paving machine of claim 1, wherein the controller retracts the one or more extender mechanisms after the screed plate has travelled approximately ⅔ of a length of the screed plate.

6. The paving machine of claim 1, wherein a paving machine operator can input a starting depth into the controller and the controller extends the extender mechanisms a proper distance to support the screed at a proper starting depth.

7. The paving machine of claim 1, wherein the one or more extender mechanisms can include a wear plate on a bottom surface.

8. The paving machine of claim 1, wherein the controller extends the one or more extender mechanisms to provide for a proper angle of attack of the screed.

9. A paving machine comprising:

a frame;

a screed coupled to the frame by a tow arm, the screed including a primary screed plate;

two movable extender mechanisms, one of each of the two movable extender mechanisms located at each rear corner of the primary screed plate, the two movable extender mechanisms configured to physically extend and retract up and down beneath a bottom surface the primary screed plate such that, when extended beneath the bottom surface of the screed plate, the movable extender mechanisms physically contact a base surface; and a controller configured to extend the two movable extender mechanisms a pre-determined distance beneath the bottom surface of the screed plate before the screed begins a paving operation to define a starting depth and to retract the two movable extender mechanisms upwards after the screed has begun the paving operation.

10. The paving machine of claim 9, further including two extender screed plates located next to the primary screed plate, each of the extender screed plates including a moveable extender mechanism.

11. The paving machine of claim 9, wherein the two movable extender mechanisms include position sensing cylinders.

12. The paving machine of claim 9, wherein the two movable extender mechanisms include threaded actuators.

13. The paving machine of claim 9, wherein the screed is coupled to the frame by a tow arm.

14. The paving machine of claim 9, wherein the controller retracts the two extender mechanisms after the primary screed plate has travelled approximately ⅔ of a length of the primary screed plate.

15. The paving machine of claim 9, wherein a paving machine operator can input a starting depth into the controller and the controller extends the two movable extender mechanisms a proper distance to support the screed at a proper starting depth.

16. The paving machine of claim 9, wherein the two extender mechanisms can include a wear plate on a bottom surface.

17. A method of setting up a screed prior to a paving operation, the method comprising:

physically extending one or more movable extender mechanisms downward beneath a bottom surface of a screed plate until the movable extender mechanisms physically contact a base surface to define a starting depth for the screed plate; and retracting the one or more movable extender mechanisms upwards after the paving operation has begun.

18. The method of claim 17, wherein the one or more movable extender mechanisms include position sensing cylinders.

19. The method of claim 17, wherein the one or more movable extender mechanisms include threaded actuators.

20. The method of claim 17, including retracting the one or more extender mechanisms after the screed plate has travelled approximately ⅔ of a length of the screed plate.

* * * * *